US009867744B2

(12) United States Patent
Krolick et al.

(10) Patent No.: US 9,867,744 B2
(45) **Date of Patent: *Jan. 16, 2018**

(54) EMERGENCY LIFT AND TRANSPORT SYSTEM

(71) Applicants: Robert S Krolick, Roseville, CA (US); Sanford Shapiro, San Rafael, CA (US); Duane Carling, Farmington, UT (US)

(72) Inventors: Robert S Krolick, Roseville, CA (US); Sanford Shapiro, San Rafael, CA (US); Duane Carling, Farmington, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/443,090

(22) Filed: Feb. 27, 2017

(65) Prior Publication Data

US 2017/0165136 A1 Jun. 15, 2017

Related U.S. Application Data

(63) Continuation-in-part of application No. 14/741,299, filed on Jun. 16, 2015, now Pat. No. 9,579,240.

(51) Int. Cl.

| | |
|---|---|
| ***A61G 1/003*** | (2006.01) |
| ***A61G 1/013*** | (2006.01) |
| ***A61G 1/056*** | (2006.01) |
| ***A61G 7/12*** | (2006.01) |
| ***A61G 1/04*** | (2006.01) |
| ***A61G 1/06*** | (2006.01) |
| ***A61G 7/012*** | (2006.01) |

(52) U.S. Cl.
CPC ..... *A61G 1/003* (2013.01); *A61G 1/013* (2013.01); *A61G 1/04* (2013.01); *A61G 1/056* (2013.01); *A61G 1/06* (2013.01); *A61G 7/012* (2013.01)

(58) Field of Classification Search
CPC .... A47C 19/045; A61G 1/013; A61G 1/0212; A61G 1/0565; A61G 7/012; A61G 13/06; A61G 1/003; A61G 1/04; A61G 1/06; B66F 3/28; B66F 5/04; B66F 7/08
See application file for complete search history.

(56) References Cited

U.S. PATENT DOCUMENTS 2,202,383 A 12/1937 Hymer et al.
3,901,356 A * 8/1975 Butler ..... B66F 7/065 187/211
4,273,306 A * 6/1981 Chang ..... A47B 9/16 108/145

(Continued)

*Primary Examiner* — Nicholas F Polito
(74) *Attorney, Agent, or Firm* — Steven A. Nielsen; www.NielsenPatents.com

(57) ABSTRACT

A lift system 100 may comprise two sets of two pistons with each set of pistons attached to an upper cross bar 210 and a lower cross bar 275, with the lower cross bar having distal ends comprising distal insertion areas 276 with the distal insertion areas passing through a first void 241 defined within a wheelie bar 240 and the distal insertion areas 276 reaching further to move a wedge bar 270. To lift a patient from a lowered position, a piston moves a lower cross bar 275 which in turn moves a wedge bar 270 into a wedge 280, causing the lower cross bar to break out of plane with a top bar 205. The use of two wheelie gears 220 ensures that the lift remains horizontal even if piston forces are not uniform.

10 Claims, 21 Drawing Sheets

(56) References Cited

U.S. PATENT DOCUMENTS

| | | | | |
|---|---|---|---|---|
| 4,549,720 | A * | 10/1985 | Bergenwall | A47B 9/16 187/269 |
| 4,987,620 | A | 1/1991 | Sharon | |
| 6,336,235 | B1 | 1/2002 | Ruehl | |
| 6,381,781 | B1 | 5/2002 | Bourgraf et al. | |
| 6,389,623 | B1 | 5/2002 | Flynn et al. | |
| 6,799,770 | B2 | 10/2004 | Patrick et al. | |
| 7,013,510 | B1 * | 3/2006 | Johnson | A61G 1/0562 296/20 |
| 9,107,781 | B1 * | 8/2015 | Edgerton | A61G 7/012 |
| 9,351,584 | B1 * | 5/2016 | Rizzardo | A47C 19/045 |
| 9,579,240 | B2 * | 2/2017 | Krolick | A61G 1/017 |
| 2006/0016008 | A1 * | 1/2006 | Choi | A61G 1/0562 5/611 |
| 2015/0359693 | A1 * | 12/2015 | Lyon | A61G 7/015 5/610 |

* cited by examiner

EMERGENCY LIFT AND TRANSPORT SYSTEM

RELATED PATENT APPLICATION AND INCORPORATION BY REFERENCE

This utility patent application is a continuation-in-part of U.S. patent application Ser. No. 14/741,299 filed on Jun. 16, 2015. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

BACKGROUND OF THE INVENTION (1) Field of the Invention

The invention generally relates to low profile stretchers that rise in a horizontal position. More particularly, the invention relates to the use of unique rotational and sliding components that are inwardly layered to create a low profile lift that moves a patient from the floor to a raised position without human effort in the lifting.

(2) Description of the Related Art

In the related art, health care workers and first responders face the dilemma of moving a patient from the ground to a raised position. Such workers often suffer significant injuries in manually lifting a patient off of the ground. A traditional folding cot stretcher having a wood frame and cloth body provides a low profile platform wherein a patient may be rolled or slid upon the cloth body or patient surface. The wood and cloth stretcher is then lifted off of the ground by workers. While sliding or rolling a patient upon a low profile prior art cot stretcher presents a minimal risk of injury, manually lifting the stretcher presents a significant risk of injury.

In the related art, stretchers with mechanical means of lift are known, but present a raised profile, inviting injury to workers lifting a patient upon the raised platform. For example, U.S. Pat. No. 6,389,623 issued on May 21, 2002 to Flynn et al presents a modern iteration of the classical ambulance stretcher and discloses a flat stretcher near the ground and provides a scissor type frame to lift the stretcher off of the ground. FIG. 12 of Flynn presents a profile view of the stretcher in its lowest position and shows several components, vertically configured, between the patient surface and the ground. The existence of components between the patient surface and the ground represents a vertical distance requiring the manual lifting of a patient.

European patent application 90830259.9, publication No. EP 0 406 178 A2 by Corradi discloses a wheeled stretcher used to move a patient from a bed to a stretcher and vice versa. The Corradi stretcher relies upon a standing frame to keep the structure at a bed level and is not designed to lift a patient from the ground. While the Corradi stretcher will move a patient from bed to bed, Corradi fails to lift a patient from the ground.

The related art fails to disclose or suggest means or methods of providing a stretcher having a patient surface at near ground level and means of mechanically lifting the patient to a raised position. Health care workers currently injure themselves lifting up prior art wood and cloth stretchers or from lifting patients upon the raised platforms of prior art mechanical lifts. Thus, there are significant shortfalls in the prior art.

BRIEF SUMMARY OF THE INVENTION

The present invention overcomes shortfalls in the related art by presenting an unobvious and unique combination, configuration and use of components to present a low profile stretcher having mechanical means of lifting a patient in a horizontal position. Disclosed embodiments overcome shortfalls in the art by providing a unique set of components that are horizontally layered so as to present an initial low profile from the ground and efficient means of mechanical lift. The presently disclosed embodiments provide the low profile of a wood and cloth cot stretcher but with mechanical means of lifting a patient, thus greatly reducing the risk of injury to health care workers.

Disclosed embodiments overcome shortfalls in the art with an efficient configuration of an integrated piston design, and in the disclosed embodiments, using four pistons. Mechanical lift may be achieved by use of integrated pistons that may be powered by any means such as hydraulics, hand or foot pumps, $CO_2$ cartridges, pulleys and hand cranks. The integrated piston system achieves a low profile and mechanical efficiency by attachment to an upper cross bar and attachment to a lower cross bar, with the lower cross bar moving within a first track or void of a wheelie bar, with the lower cross bar further penetrating the wheelie bar and moving a wedge bar. The wedge bar may be initially positioned to the inside of a top bar, with the top bar attached to a wedge. Starting in a flat position, as the piston is moved, the lower cross bar moves within a wheelie bar and moves the wedge bar into the wedge, causing an initial lifting movement.

The initial movement of the wedge bar into the wedge starts the initial vertical movement of the wheelie bar. The first longitudinal void of the wheelie bar not only retains the powered lower cross bar but also assists in transferring movement of the piston to angular movement of the wheelie bar.

Disclosed embodiments overcome the related art by presenting a four piston system that allows each piston system to be smaller than other systems and allows for less pressure needed per piston. The use of smaller pistons is conducive to achieve a low profile and low weight such that the system may be stored flat upon a wall, ready for use.

Disclosed embodiments overcome shortfalls in the art by the use of a wheelie gear that integrates with a wheelie bar and a center hinge assembly. The use of two top bars, used to secure two wheelie gears overcomes shortfalls in the art by the geared movement of two sets of wheelie bars. Thus, the disclosed lifts move upwardly and downwardly in a uniform and level manner. The use of two wheelie gears ensures that uneven piston movement does not skew, rack or otherwise degrade system performance. Geared attachment between the two wheelie gears keeps both sides of the lift level at all times.

These and other advantages over the prior art will become even more apparent after consideration of the drawings and more detailed description.

REFERENCE NUMERALS IN THE DRAWINGS

Figure 1A:
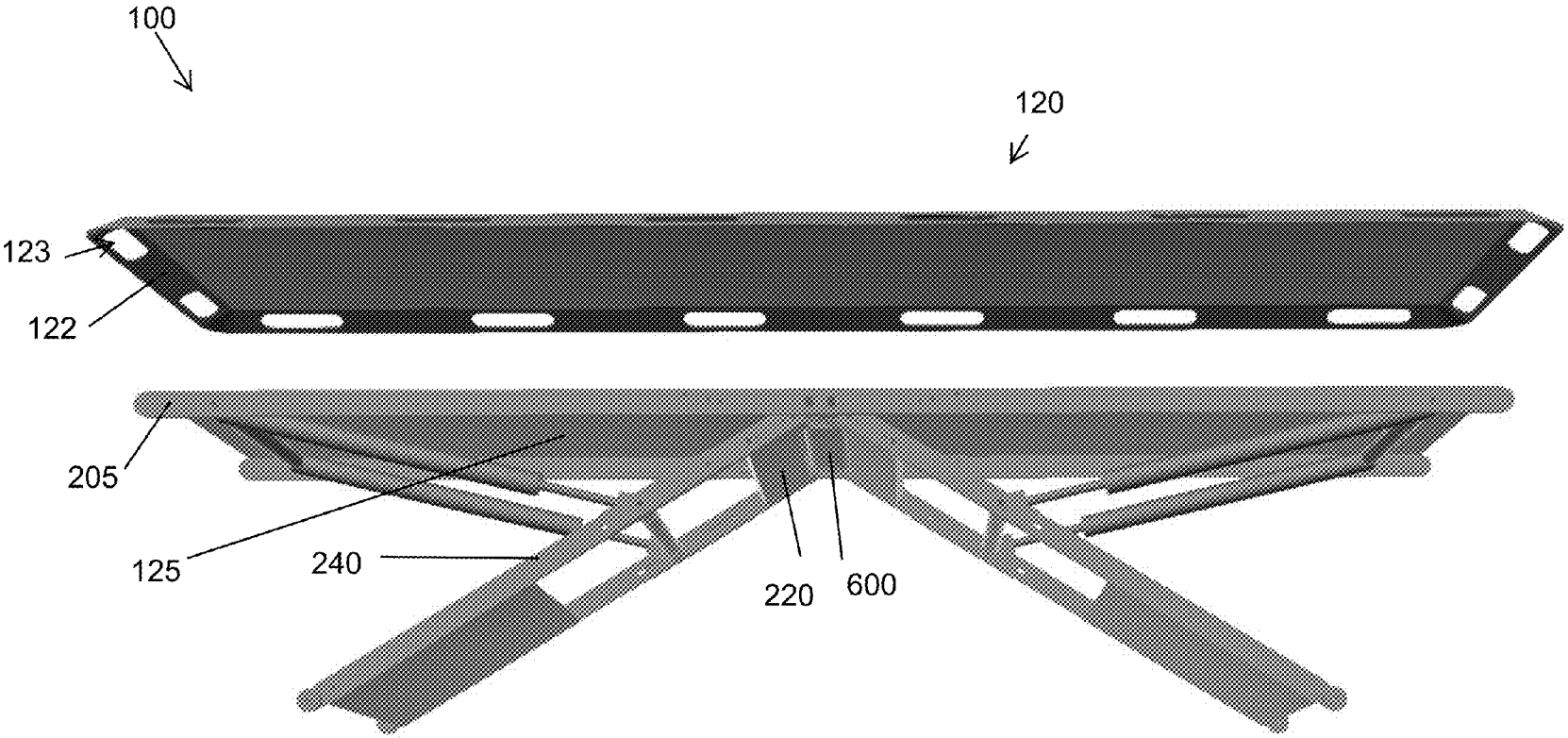
FIG. 1A is a perspective view of a lift system

100 lift in general
120 body board
122 angled wall or skirt of body board
123 hand void defined within the angled wall 122 of the body board 120
125 back board
205 top bar
206 center voids defined within center section of top bar, may be used to retain wheelie gear and/or center assembly 280
210 cylinder rod cross head or upper cross bar, may be of same or similar construction as cross bar or lower cross bar 275
212 distal end of upper cross bar 210
220 wheelie gear
221 cross bar of wheelie gear 220
224 side bar of wheelie gear 220
227 gear teeth of wheelie gear
229 pivot void of wheelie gear 220
239 optional wheel sometimes found at end of wheelie bar
240 wheelie bar
241 first longitudinal void of wheelie bar 240, may retain cross bar 275
242 pivot attachment voids of wheelie bar 240
243 second longitudinal void of wheelie bar 240, may retain cambered side of wedge bar 270
245 body or longitudinal body of wheelie bar 240
260 cylinder
265 piston
267 cylinder rod clevis
269 second void of wedge bar, sometimes used to retain pin inserted into a second void of a wheelie bar
270 wedge bar
271 cambered edge of wedge bar 270 used with angled edge 281 of wedge 280
272 indent area of wedge bar, used to retain wedge washer
273 void of wedge bar
274 longitudinal body of wedge bar 270
275 cross bar or lower cross bar
276 distal insertion area, used to mate with void of wheelie bar
278 main longitudinal section of cross bar 275
279 retention area of cross bar 275, may be used to retain a cylinder rod clevis 267
280 wedge
281 angled edge of wedge 280, interfaces with cambered edge 271 of wedge bar 270
282 void or voids defined within a wedge
450 reinforcement plate
600 center hinge assembly, may comprise two attached cylinders with each cylinder defining two voids with each void having a pin inserted into a void 229 defined by the gear teeth 228 of a wheelie gear 220.

These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

Referring to FIG. 1A, a perspective view of a disclosed embodiment 100 is shown in an expanded position. A disclosed embodiment may include a body board 120 with the body board defining a plurality of hand voids 123 within a tilted perimeter collar area 122. The body board 120 may be easily removed from the system and may be sometimes considered to be free floating.

The body board 120 may be disposed upon a backboard 125 with the back board attached to two top bars 205. The artful integration of the body board upon the backboard allows for the easy transport of patients upon or off of the lift system. The body board provides a mechanical advantage of having shallow handles that are disposed over the vertical portions of the lift, so as to not add vertical height to the lift.

Figure 1B:
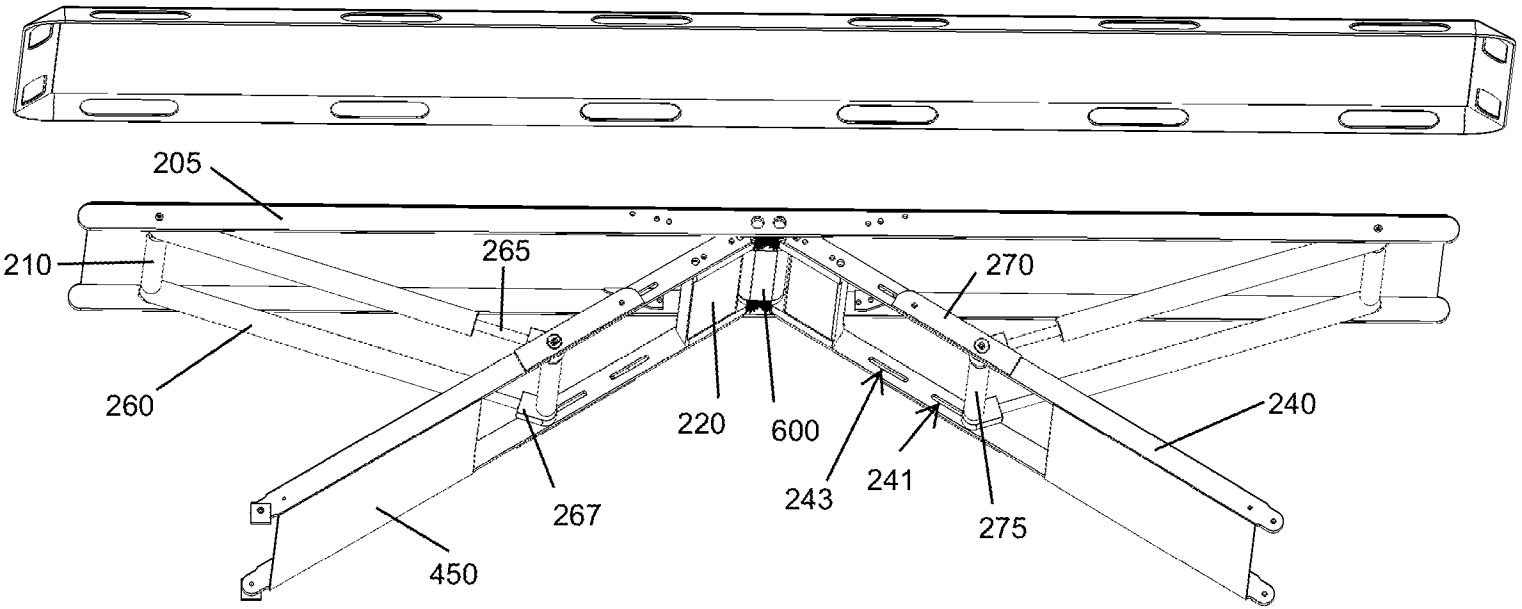
FIG. 1B is a perspective view of a lift system

FIG. 1B depicts a perspective view of a system wherein a top bar may have a distal side pivotally attached to an upper cross bar 210 or cylinder rod cross head, with the upper cross bar having distal pin protrusions pivotally attached to a cylinder 260, with the cylinder in sliding attachment to a piston 265 with the piston in rotational attachment to lower cross bar 275 with the lower cross bar comprising (See FIG. 16) a main longitudinal body or section 278, distal ends comprising a retention area 279 and a distal insertion area 276. Referring back to FIG. 1B, a cylinder rod clevis 267 may be found between the distal end of the piston and the distal side of the lower cross bar. The distal insertion area of the lower cross bar may be inserted through a longitudinal void 241 defined within a wheelie bar 240. The distal insertion area may further extend into or through a wedge bar 270. The wedge bar may travel or slide along the body of the wheelie bar 240 to assist in pressing the wedge bar into a wedge (See FIG. 5 part 280) so as to rotate the wheelie bar 240 away from the top bar 205.

A proximal side of the wheelie bar 240 may be attached to a wheelie gear 220 and the wheelie gear may be rotationally attached to a center hinge assembly 600 and the center hinge assembly may be attached to the mid-section or center section of the top bar 205. The distal ends of the wheelie bars 240 may be attached to wheels or a reinforcement plate. The distal ends of each pair of wheelie bars may be attached to reinforcement plates 450. Reinforcement plates 450 provide a mechanical advantage in keeping the wheelie bars from twisting.

Disclosed embodiments overcome shortfalls in the art by use of four pistons or four systems of linear movement exerted between the top cross bar and the bottom cross bar. While a disclosed lift is in a flat position, the outward or expanding movement of each piston urges a wedge bar 270 into a wedge, initiating the rotational movement of the wheelie bar 240 away from the top bar 205. The artful configuration of the wedge bar sliding along the wheelie bar and the artful configuration of the lower cross bar being moved by the piston such that the lower cross bar transfers movement to the wedge bar provides a mechanic advantage in presenting a very flat initial position of the lift such that patients can be rolled on to the lift.

The movement of the lower cross bar 275 within the longitudinal void 241 of the wheelie bar 240 provides a mechanical advantage of both initiating a vertical or separation movement between the wheelie bar 240 and top bar 205 and creating additional angle or additional rotation between the wheelie bar and top bar in both raising a patient and in returning the lift to its original flat position.

Disclosed embodiments overcome shortfalls in the art by use of four pistons or four systems of linear movement exerted between the top cross bar and the bottom cross bar. While a disclosed lift is in a flat position, the outward or expanding movement of each piston urges a wedge bar 270 into a wedge, initiating the rotational movement of the wheelie bar 240 away from the top bar 205. The artful configuration of the wedge bar sliding along the wheelie bar and the artful configuration of the lower cross bar being moved by the piston such that the lower cross bar transfers movement to the wedge bar provides a mechanic advantage in presenting a very flat initial position of the lift such that patients can be rolled on to the lift.

The movement of the lower cross bar 275 within the longitudinal void 241 of the wheelie bar 240 provides a mechanical advantage of both initiating a vertical or separation movement between the wheelie bar 240 and top bar 205 and creating additional angle or additional rotation between the wheelie bar and top bar in both raising a patient and in returning the lift to its original flat position.

Figure 2A:
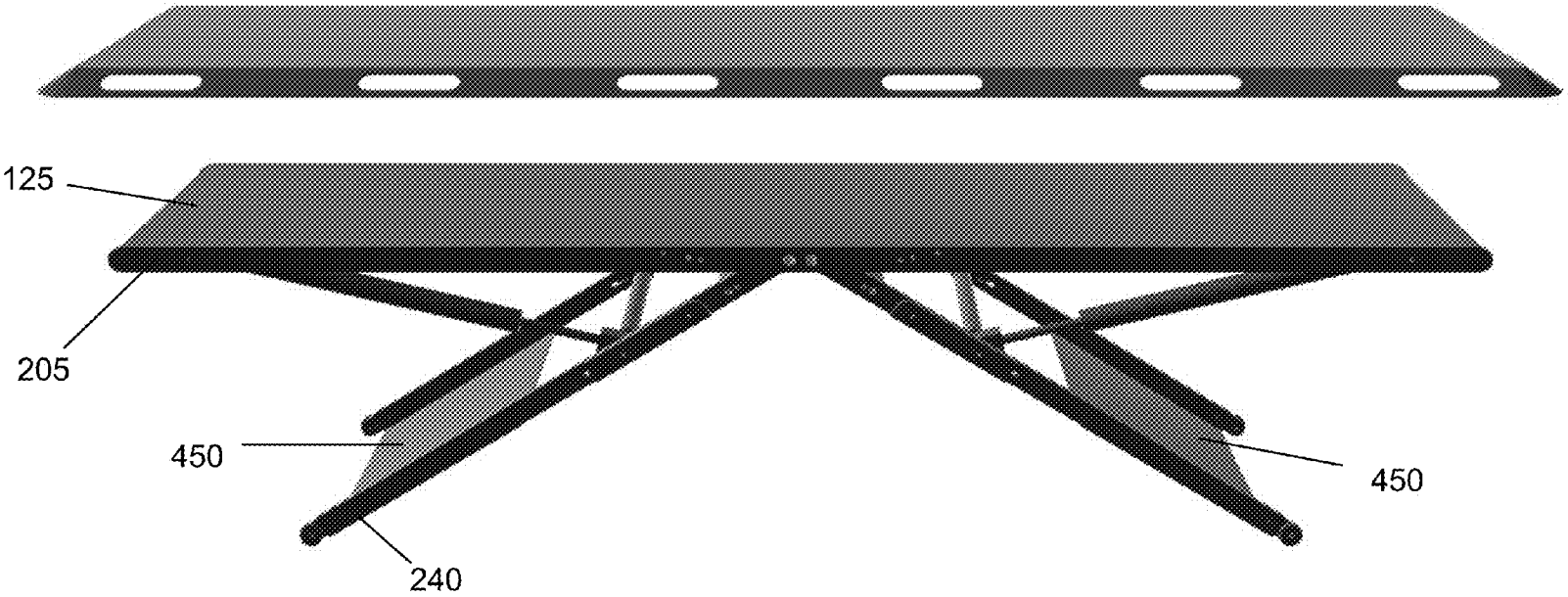
FIG. 2A is a perspective view of a lift system

FIG. 2A depicts a perspective view of a system shown in an expanded position with two top bars 205 held in parallel. In the expanded position shown, a patient may be raised from a very low position with mechanical means, thus preserving the backs of the involved health care workers. Disclosed embodiments may also include one or more reinforcement plates 450, each attached to a pair of wheelie bars 240. The use of a reinforcement plate is optional and wheels may be attached to the bottom components to comport with environmental conditions.

Figure 2B:
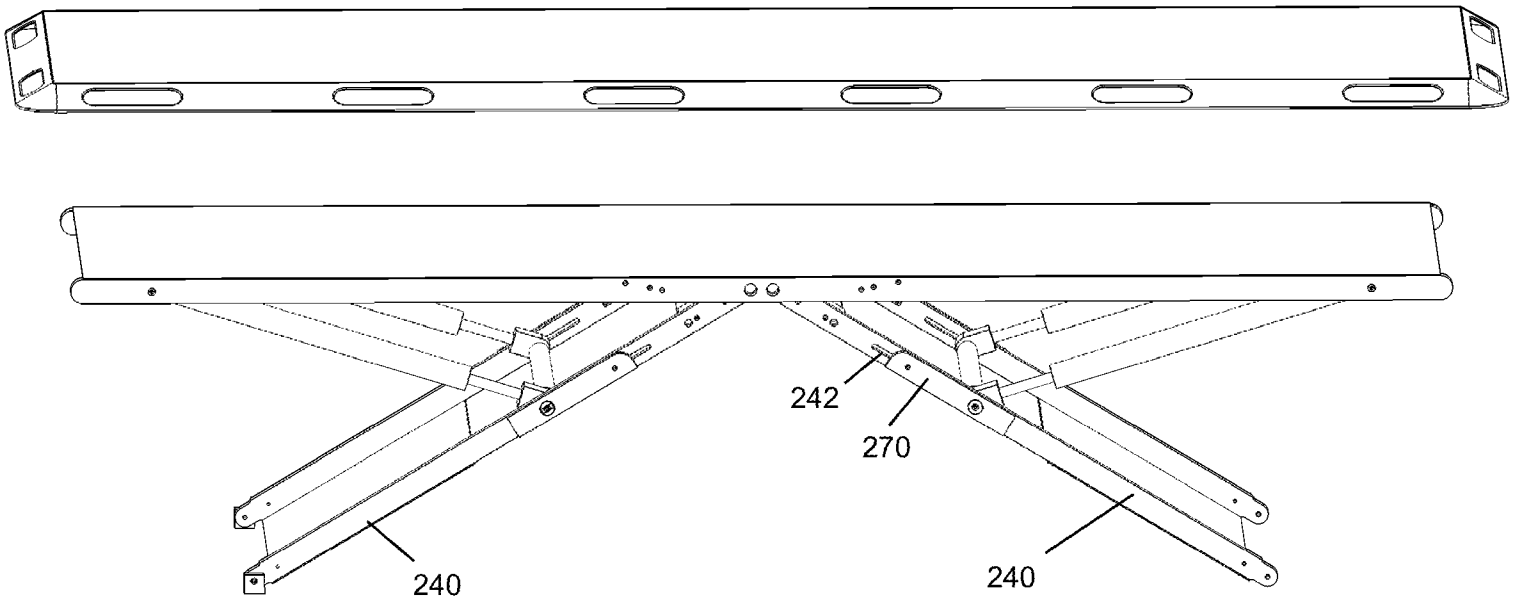
FIG. 2B is a perspective view of a lift system

FIG. 2B depicts a line view of FIG. 2A to better illustrate the shape of the wedge bar 270 and how the wedge bar moves along the wheelie bar 240.

Figure 3:
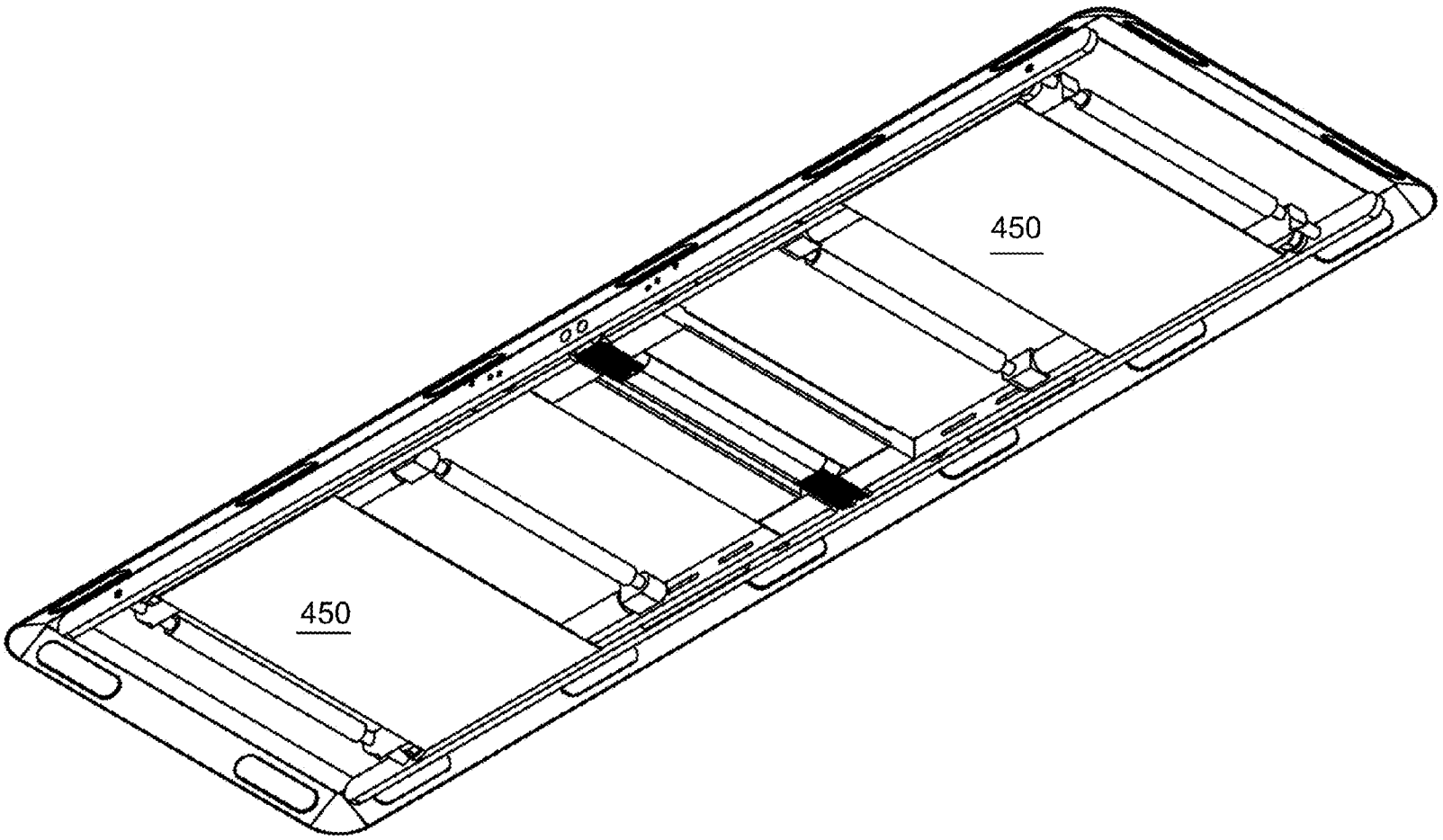
FIG. 3 is an perspective view of a lift system in a flat position

FIG. 3 depicts a disclosed system in a flat position.

Figure 4:
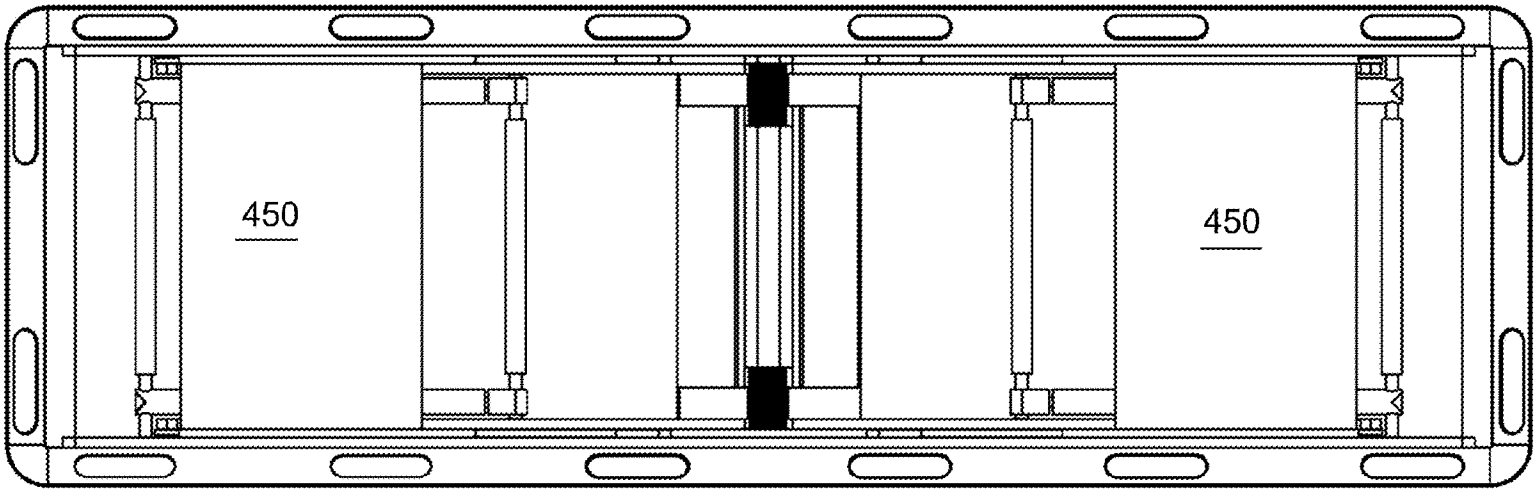
FIG. 4 is a plan view of a lift system in a flat position

FIG. 4 depicts a disclosed system in a flat position.

Figure 5:
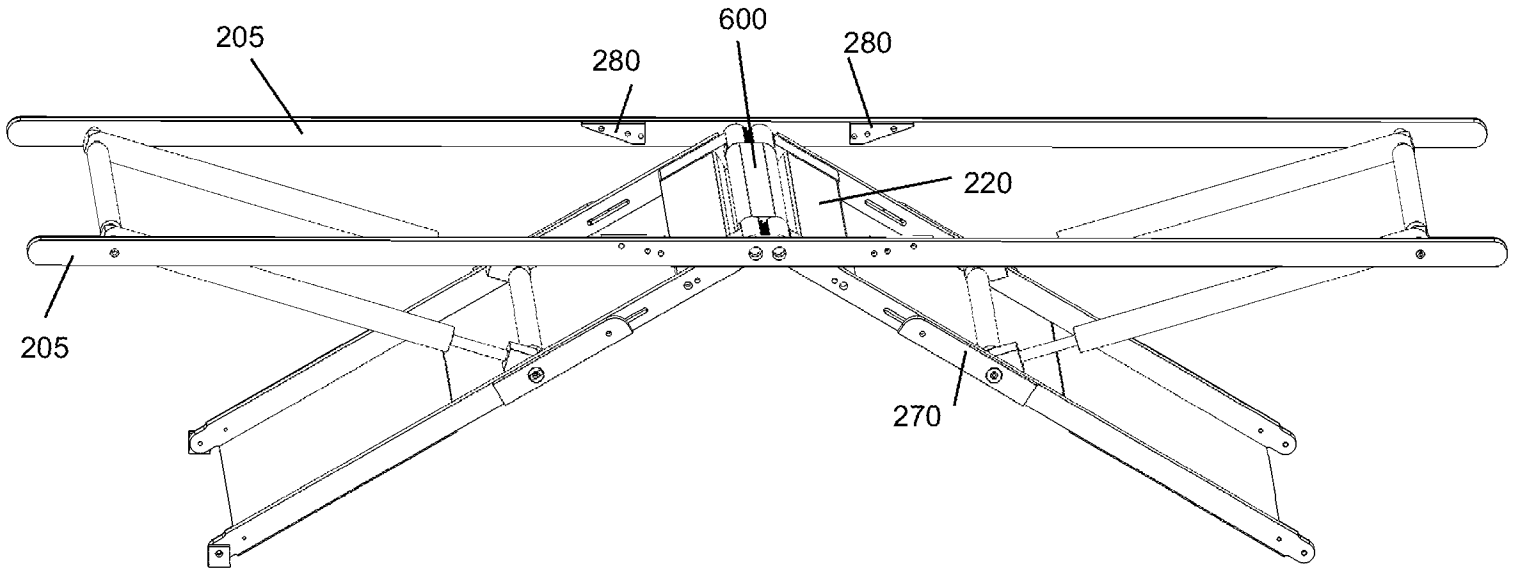
FIG. 5 is a perspective view of disclosed components

FIG. 5 depicts a disclosed system in an expanded position. To initiate movement from a flat position, the cambered edges of the wedge bars 270 press upon the angled edges of the wedges 280.

In a four piston embodiment, two top bars 205 may each be attached to two wedges 280. Each top bar may have a center or mid body location attached to a center assembly 600. On either side of the center assembly a wheelie gear 220 may be in rotational attachment to the center assembly. Moreover, each of the two wheelie gears 220 may comprise (see FIG. 18) a cross bar 221, the cross bar having two distal ends each attached to a side bar 224 with each side bar attached to a set of gear teeth 227 with the set of gear teeth defining a pivot void 229. The pivot void 229 may be in rotational attachment with the center assembly.

Referring back to FIG. 5, a first wheelie gear 220 may be in geared attachment to a second wheelie gear, by use of each wheelie gear's set of gear teeth. The geared attachment of the first wheelie gear to the second wheelie gear provides a mechanical advantage in the four piston embodiment in that the two sets of wheelie bars are forced to move at the same speed. A first set of wheelie bars may be attached to the first wheelie gear and a second set of wheelie bars may be attached to a second wheelie gear. The respective wheelie bars may be fixedly attached to a corresponding wheelie bar such that a set of wheelie bars will not rack or otherwise become askew. The geared connection of each wheelie gear ensured that both sets of wheelie bars or both sides of the lift rise and lower in unison.

To assist in the movement of the system from a flat position to an expanded position, each of the four wedge bars 270 is slidably attached to one of the four wheelie bars 240. Starting in a flat position, as shown in FIG. 3, a piston rod 265 is attached to a cylinder rod clevis 267, with the clevis attached to a cross bar 275, the cross bar having distal ends extending through a wheelie bar 240 and the cross bar distal ends attached to a wedge bar 270. As the piston rod is outwardly urged, by use of pressure added to a cylinder 260, the wedge bar 270 is moved into a wedge 280, with the wedge having an angled edge 281 (shown in FIG. 17) urging the wedge bar to move upwardly which in turn causes the attached wheelie bar 240 to move into a more vertical position.

FIG. 5 depicts a perspective view of a system with the back board removed.

Figure 6:
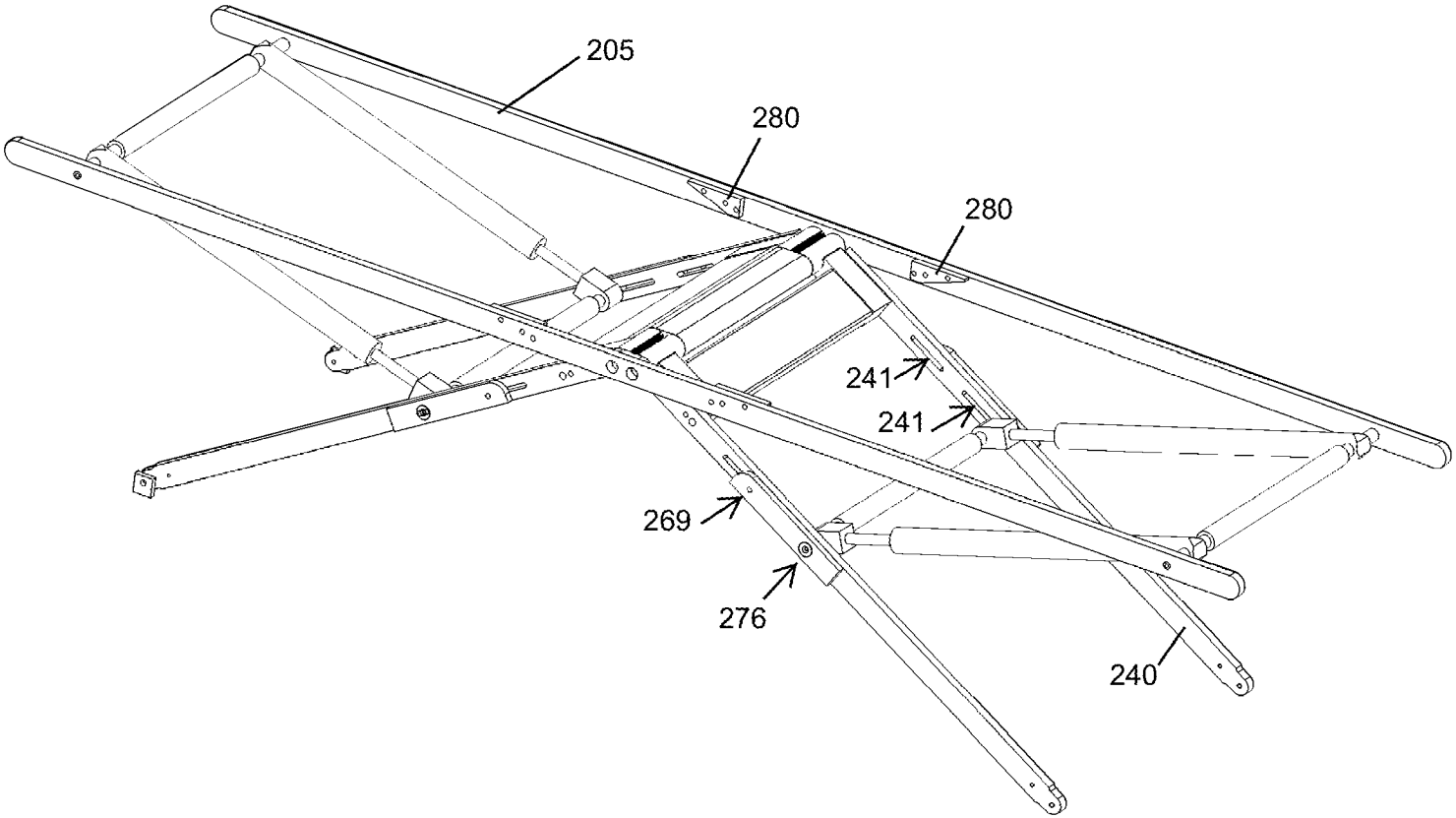
FIG. 6 is a perspective view of disclosed components

FIG. 6 depicts a perspective view of a system in an expanded position. Two wedges 280 are depicted in fixed attachment to a top bar 205. The use of two wedges for each of the two top bars provides a mechanical advantage in allowing for the use of two straight and monolith top bars 205. The use of just two top bars provides extra structural support for heavier patients and helps to provide a streamlined configuration. The use of two top bars also provides a mechanical advantage in providing convenient means of hanging the system upon a wall.

Figure 7:
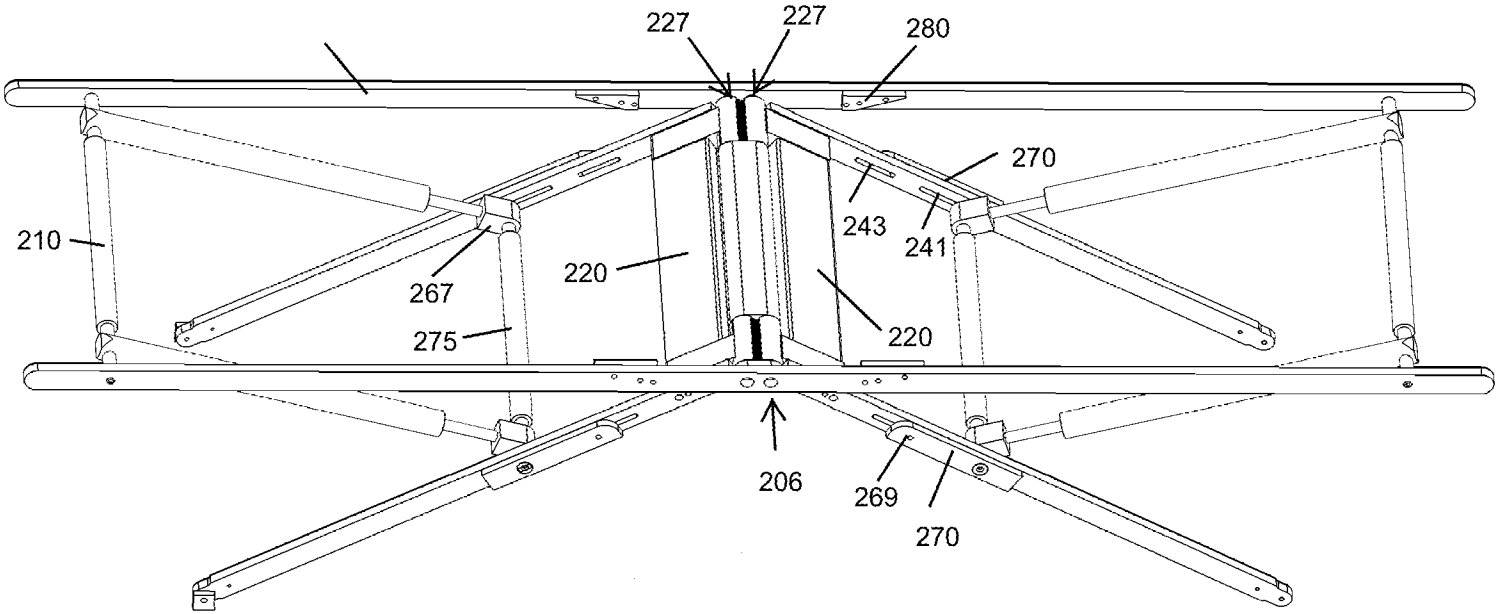
FIG. 7 is a perspective view of disclosed components

FIG. 7 depicts a perspective view of a system in an expanded position. A cylinder rod cross head 210 or upper cross bar is attached to a cylinder and piston, with the piston attached to a cylinder rod clevis and the cylinder rod clevis is attached to a lower cross bar 275. A first wheelie gear 220 is shown to be in geared attachment to a second wheelie gear 220.

Figure 8:
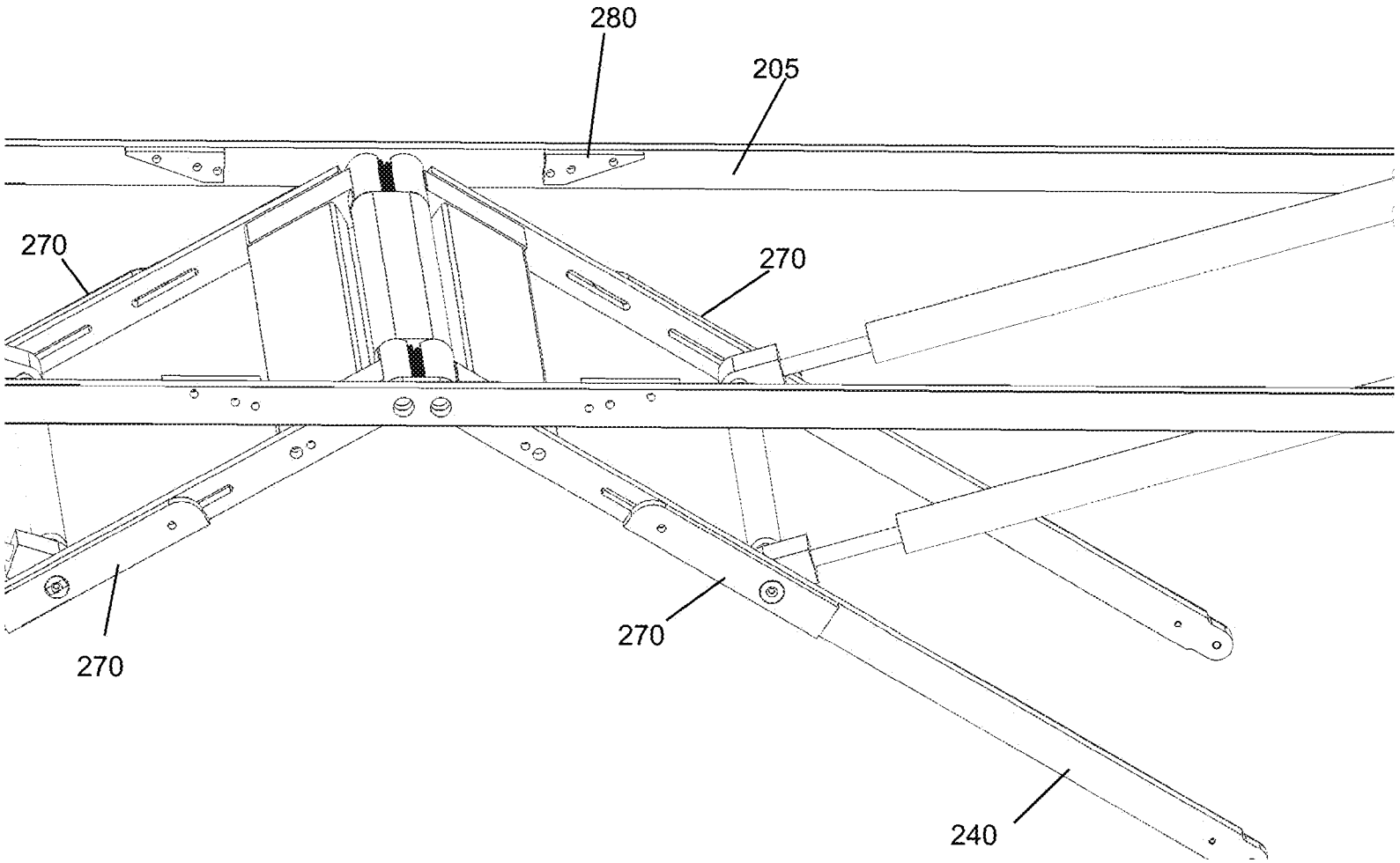
FIG. 8 is a sectional view of disclosed components

FIG. 8 depicts four wedge bars 270 attached to four wheelie bars 240.

Figure 9:
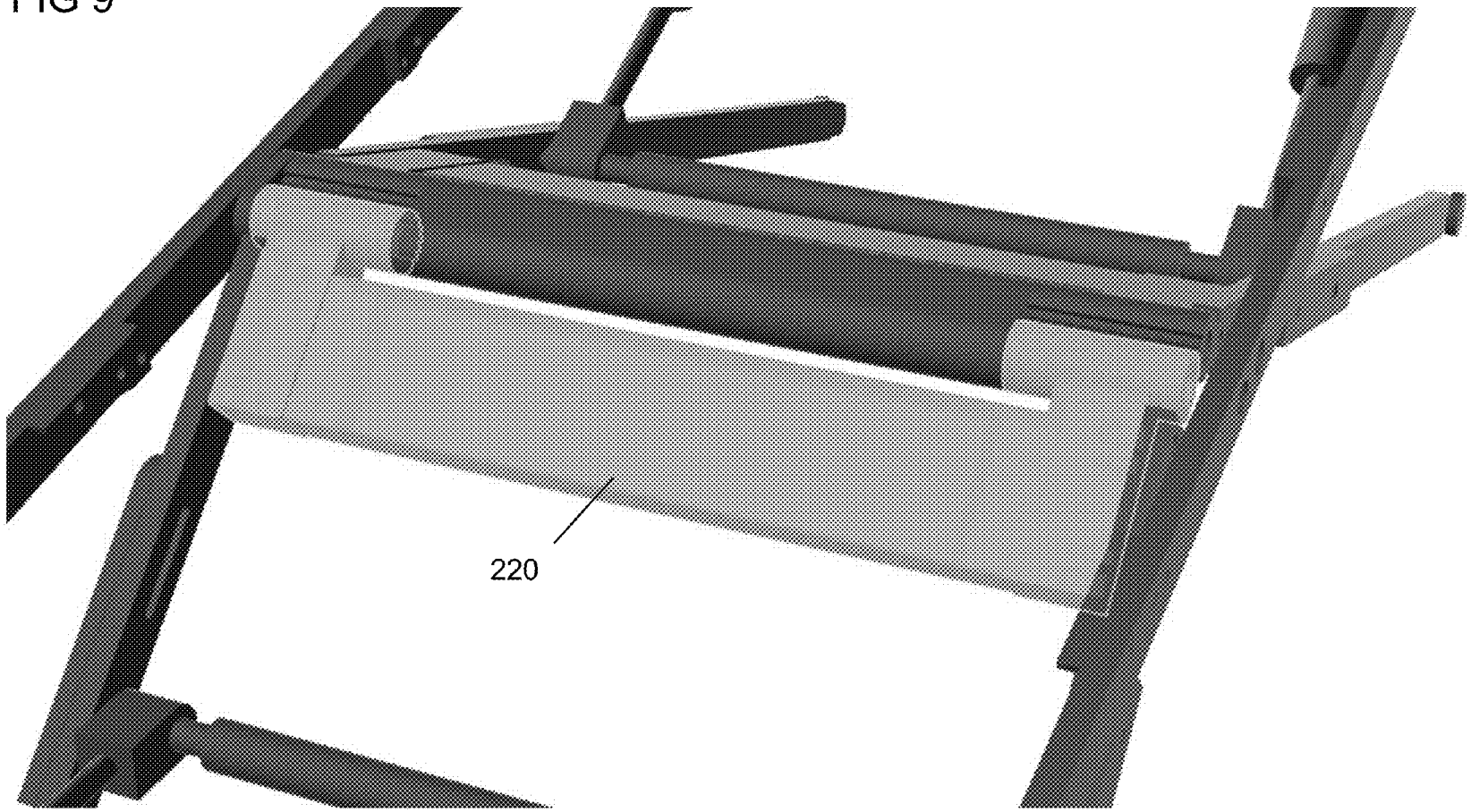
FIG. 9 is a perspective view of disclosed components

FIG. 9 depicts a wheelie gear 220 and surrounding components.

Figure 10:
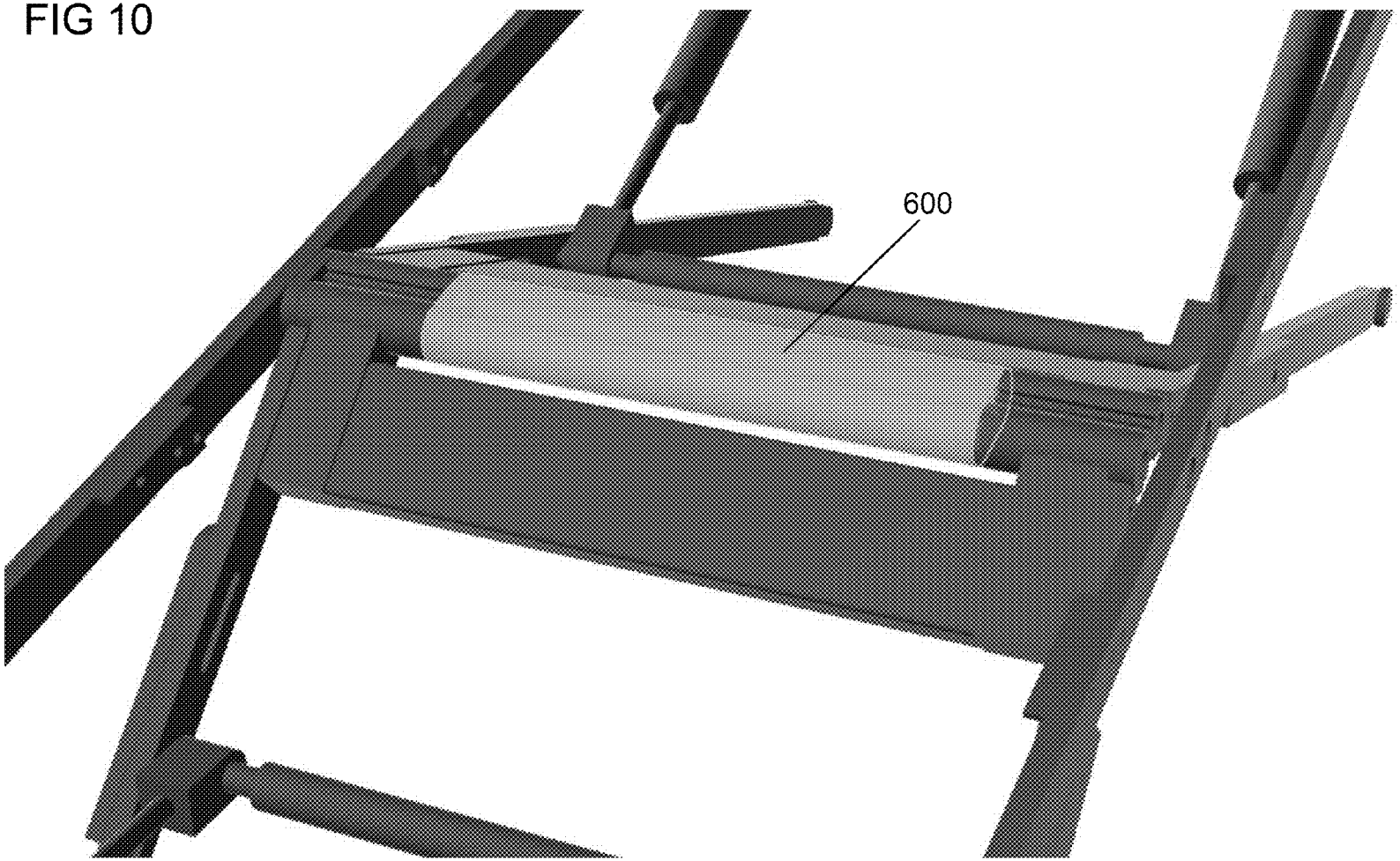
FIG. 10 is a perspective view of disclosed components

FIG. 10 depicts a center assembly 600 and related components.

Figure 11:
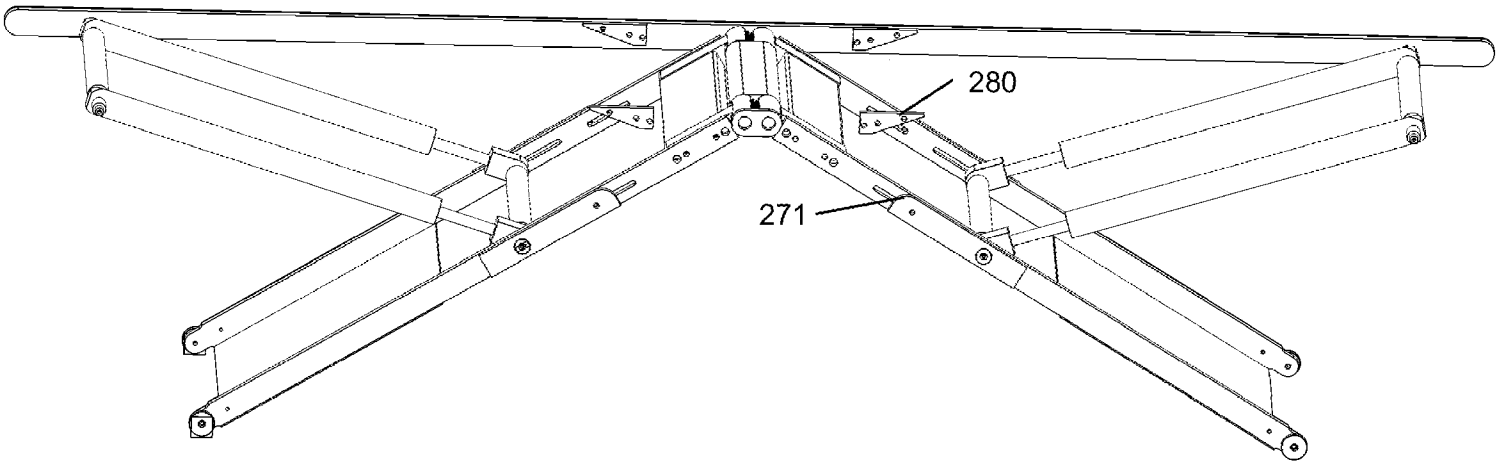
FIG. 11 is a perspective view of disclosed components

FIG. 11 depicts a perspective view of a frame with just one top bar shown. All four wedges are shown. The illustrated wedges 280 help to show the relationship between the wedges and the cambered sides 271 of the wedge bars.

Figure 12:
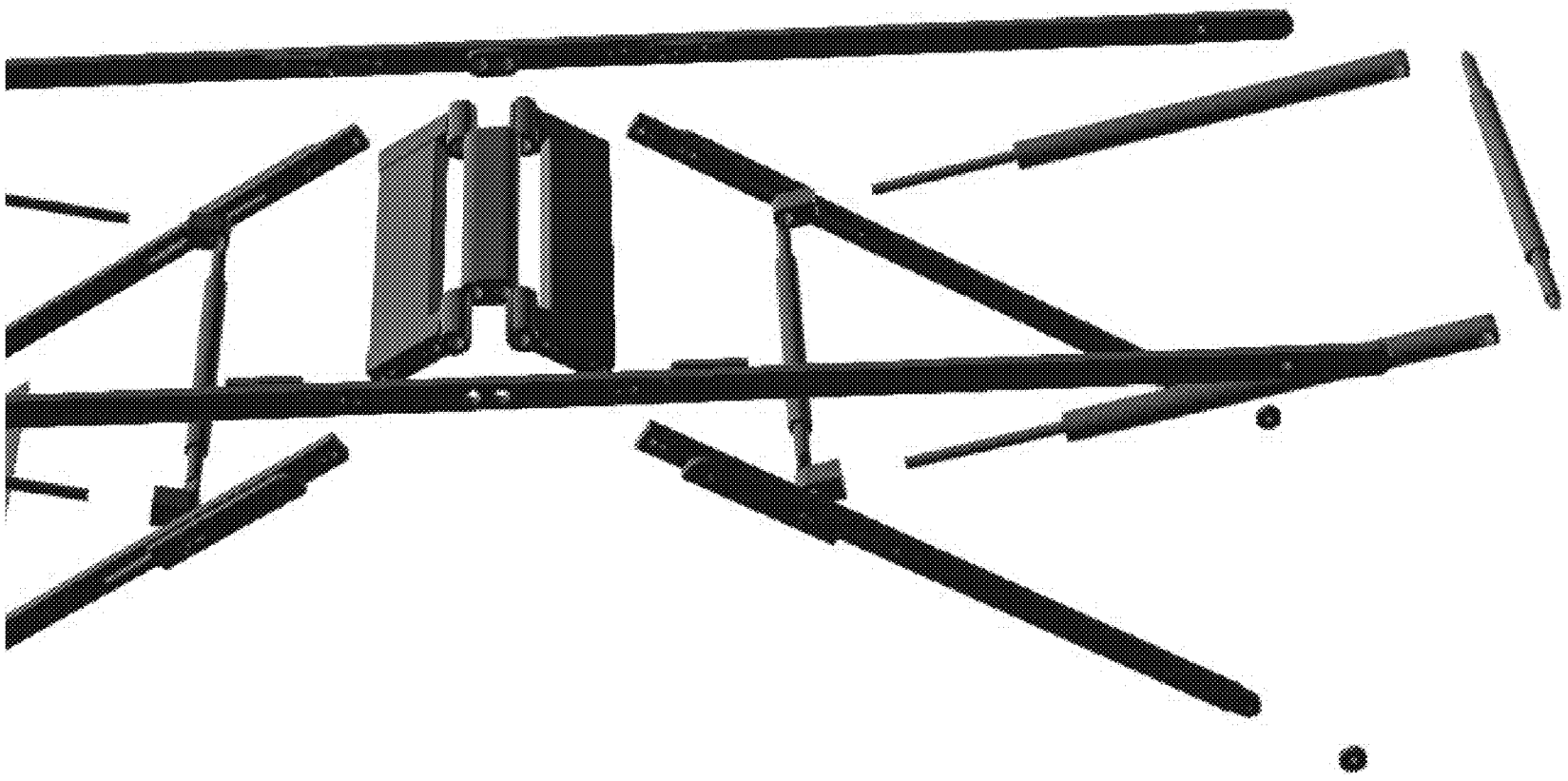
FIG. 12 is an exploded view of disclosed components

FIG. 12 depicts an exploded view of various components.

Figure 13A:
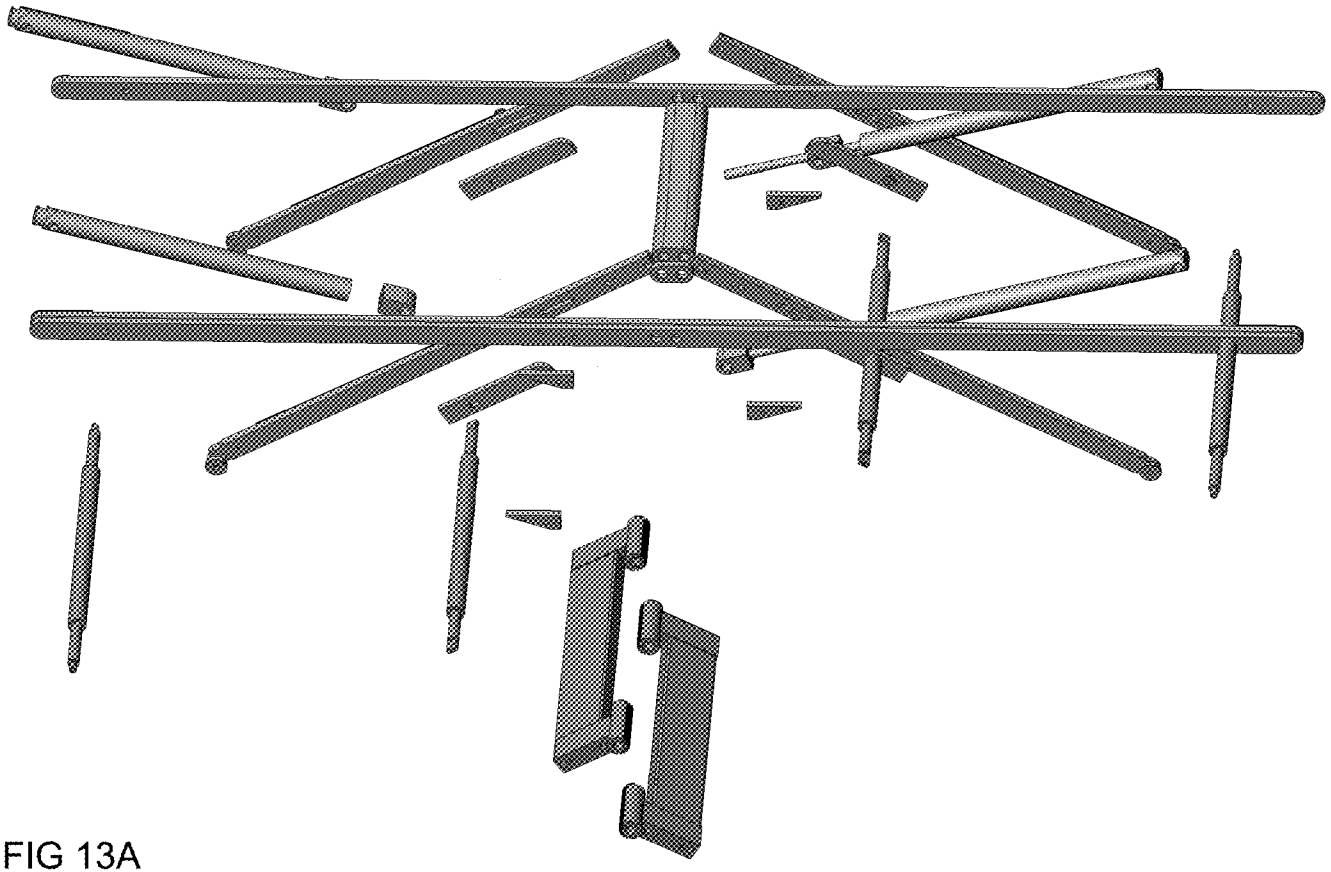
FIG. 13A is an exploded view of disclosed components

FIG. 13A depicts an exploded view of various components.

Figure 13B:
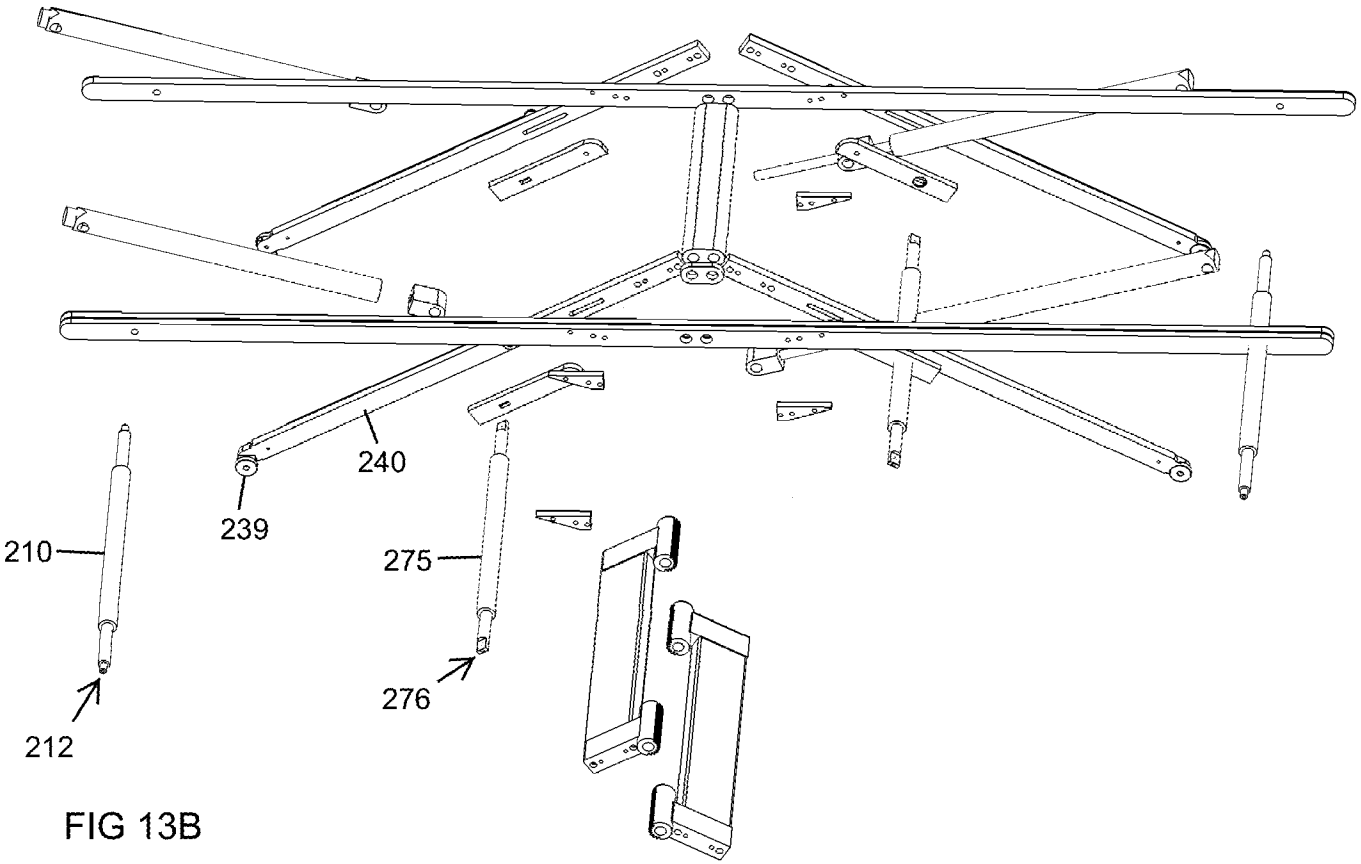
FIG. 13B is an exploded view of disclosed components

FIG. 13B depicts an exploded view of various components.

Figure 14:
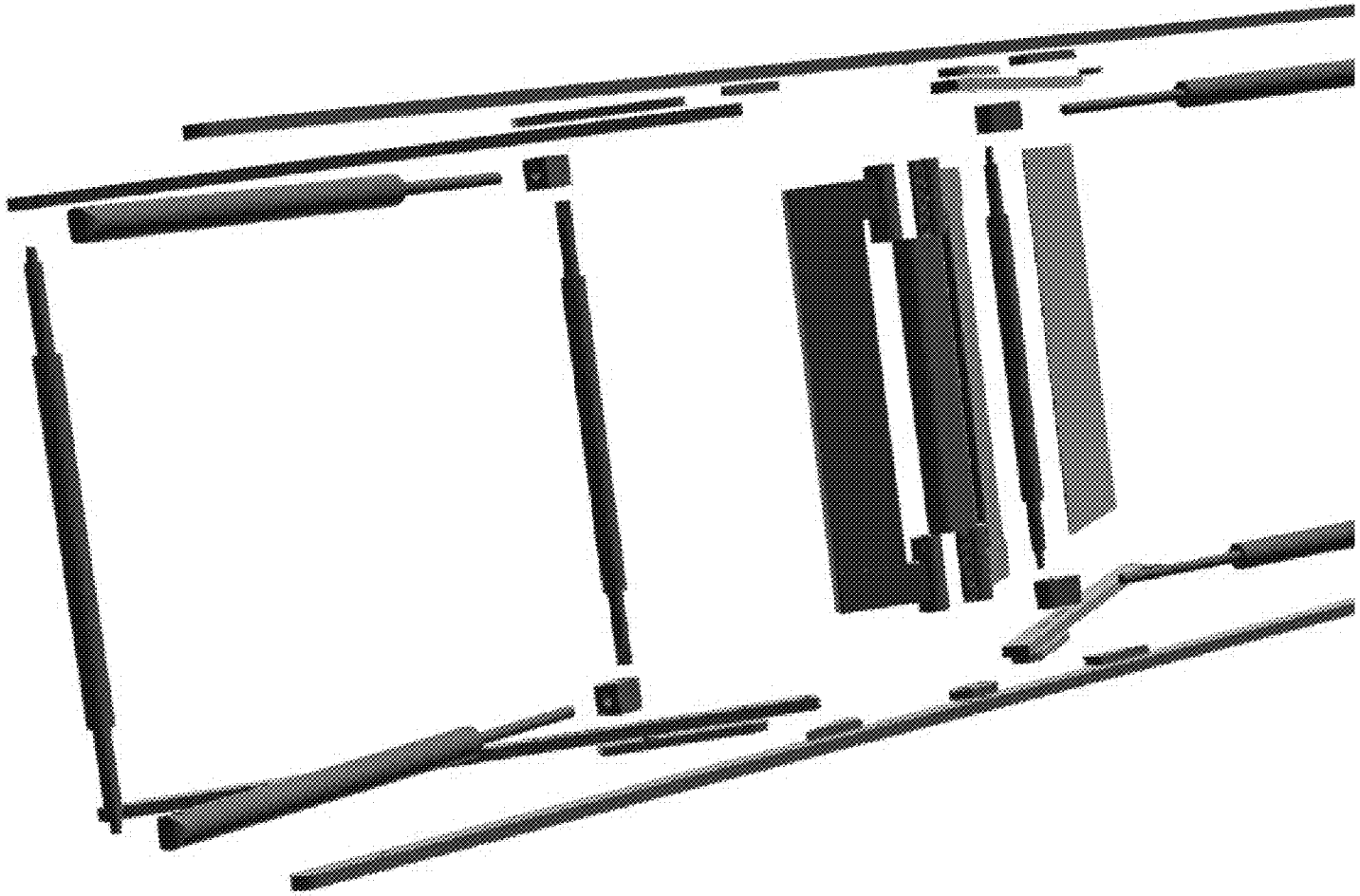
FIG. 14 is an exploded view of disclosed components

FIG. 14 depicts an exploded view of various components.

Figure 15:
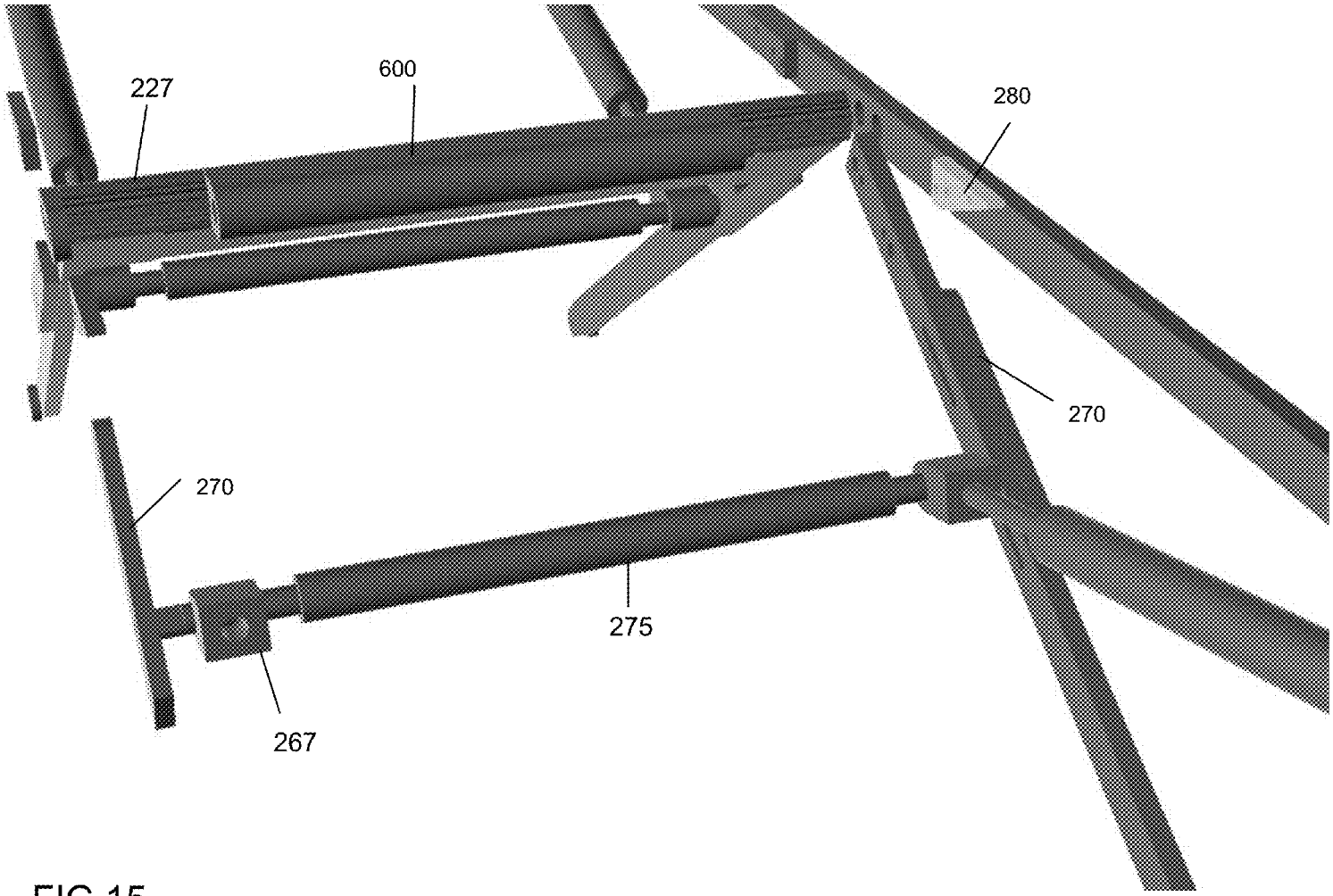
FIG. 15 is a perspective view of disclosed components

FIG. 15 depicts various components with a wheelie gear removed from the foreground.

Figure 16:
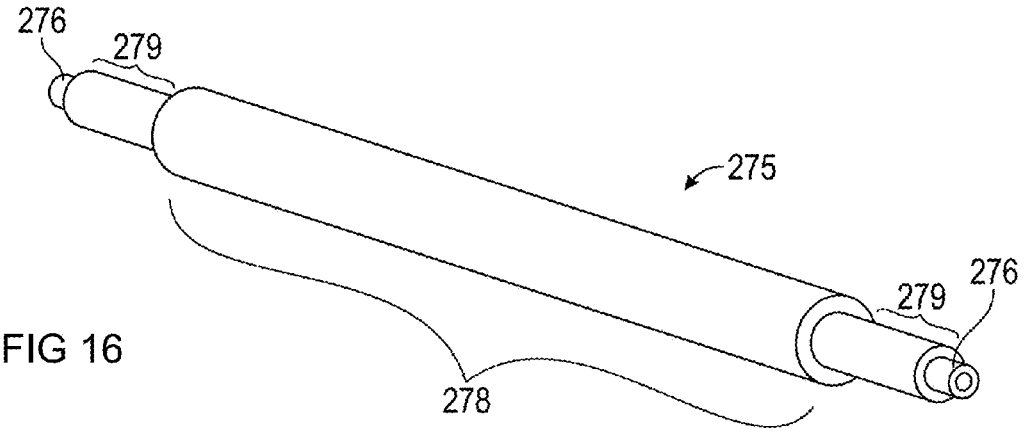
FIG. 16 is a perspective view of a cross bar

FIG. 16 depicts an upper cross bar 275, similar to a lower cross bar 210. An upper cross bar may comprise a main longitudinal section 278 having two distal sides with each distal side comprising retention area 279 and an outer distal insertion area 276. A distal insertion area 276 may be round or rectangular in shape. A distal insertion area 276 may be inserted into the first longitudinal void 241 of a wheelie bar 240 and the distal insertion area may further reach and move a wedge bar 270.

Figure 17:
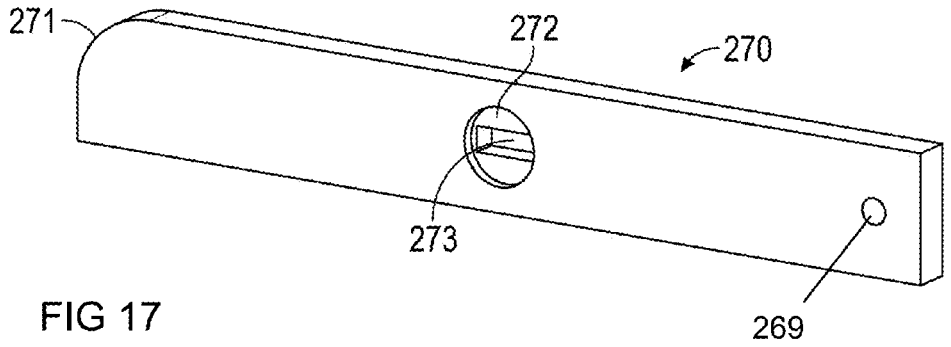
FIG. 17 is a perspective view of a wedge bar

FIG. 17 depicts a wedge bar 270 and a wedge bar may comprise cambered edge 271, the cambered edge sometimes used press upon or used to be deflected by a wedge 280. A wedge bar may define an indent area 272 and further define void 274, the void sometimes used to accept a distal end of a lower cross bar 275 or distal insertion area 276. A wedge bar 270 may also define a second void 269, the second void sometimes used to secure a pin, the pin contained within the second void 243 of a wheelie bar 240.

Figure 18:
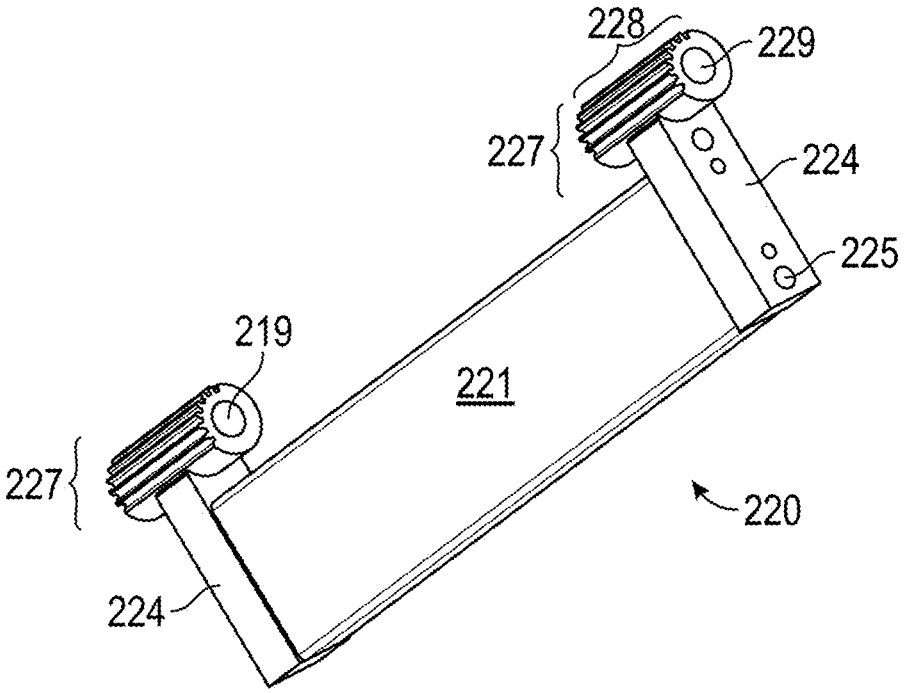
FIG. 18 is a perspective view of a wheelie gear

FIG. 18 depicts a perspective view of a wheelie gear 220. A wheelie gear may comprise a cross bar 221 having distal sides, each distal side may be attached to side bar 224 and each side bar may comprise a set of gear teeth 227, with the gear teeth defining a pivot void 229. The pivot 229 may be used to retain a pin inserted into a void of the center hinge assembly 600.

Figure 19:
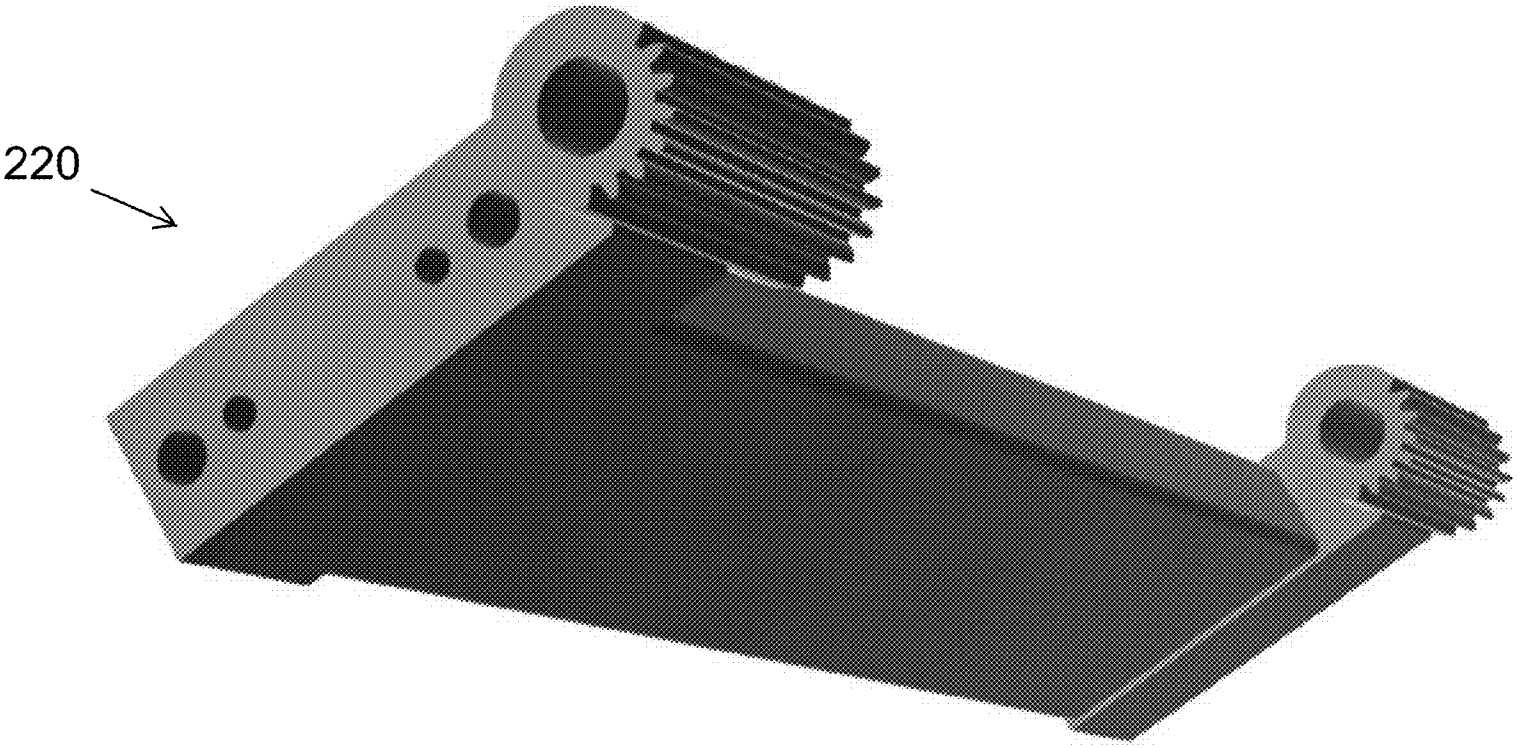
FIG. 19 is a perspective view of a wheelie gear

FIG. 19 depicts a perspective view of a wheelie gear 220.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. A lift comprising:

a) a top bar (205) fixedly attached to a wedge (280) and the top bar pivotally attached to a first wheelie gear (220), the first wheelie gear attached to two wheelie bars (240), each wheelie bar comprising a longitudinal body (245) with the longitudinal body defining a first longitudinal void (241) the first longitudinal void of the wheelie bar retaining a lower cross bar (275), with the longitudinal void allowing the lower cross bar to slide within the wheelie bar;

b) a wedge bar (270) attached to a distal end of the lower cross bar, the wedge bar comprising a first end having a cambered edge (271).

2. The lift of claim 1 further comprising at least one piston attached to the lower cross bar and an upper cross bar (210).

3. The lift of claim 2 wherein the wedge comprises an angled edge (281), the angled edge comporting to the cambered edge of the wedge bar.

4. The lift of claim 2 further comprising a cylinder rod clevis (267) attached to the lower cross bar and the piston.

5. The lift of claim 2 further comprising a cylinder (260) attached to the piston.

6. The lift of claim 2 wherein the piston is attached to an upper cross bar (210).

7. The lift of claim 2 wherein one or more wheels are attached to each of the wheelie bars.

8. The lift of claim 2 wherein a skid plate (450) is attached to each of the two wheelie bars.

9. The lift of claim 2 with a second wheelie gear in geared connection to the first wheelie gear.

10. The lift of claim 2 with four pistons, with each piston attached to a lower cross bar and a upper cross bar.

* * * * *